US012710225B2

(12) United States Patent
Bauer et al.

(10) Patent No.: US 12,710,225 B2
(45) Date of Patent: Aug. 18, 2026

(54) METHOD AND SYSTEM FOR PRODUCING A LIQUEFIED NATURAL GAS PRODUCT

(71) Applicant: Linde GmbH, Pullach (DE)

(72) Inventors: Heinz Bauer, Ebenhausen (DE); Andreas Kossmann, Munich (DE); Rebecca Henkelmann, Munich (DE)

(73) Assignee: Linde GmbH, Pullach (DE)

( * ) Notice: Subject to any disclaimer, the term of this patent is extended or adjusted under 35 U.S.C. 154(b) by 689 days.

(21) Appl. No.: 18/040,376

(22) PCT Filed: Jun. 23, 2021

(86) PCT No.: PCT/EP2021/025229

§ 371 (c)(1),
(2) Date: Feb. 2, 2023

(87) PCT Pub. No.: WO2022/028729

PCT Pub. Date: Feb. 10, 2022

(65) Prior Publication Data

US 2023/0288137 A1 Sep. 14, 2023

(30) Foreign Application Priority Data

Aug. 7, 2020 (DE) ..... 10 2020 004 821.8

(51) Int. Cl.
*F25J 1/00* (2006.01)
*F25J 1/02* (2006.01)

(52) U.S. Cl.
CPC ..... *F25J 1/0022* (2013.01); *F25J 1/008* (2013.01); *F25J 1/0229* (2013.01); *F25J 2205/30* (2013.01)

(58) Field of Classification Search
CPC ..... F25J 1/0092; F25J 1/008; F25J 1/0231; F25J 1/0214; F25J 1/0247; F25J 1/0242;
(Continued)

(56) References Cited

U.S. PATENT DOCUMENTS 2,952,983 A * 9/1960 Gilmore ..... C10G 7/02 62/631
5,291,736 A 3/1994 Paradowski
(Continued)

FOREIGN PATENT DOCUMENTS

FR 2923000 A1 5/2009
FR 2965608 A1 * 4/2012 ..... F25J 1/0214
WO 2007008525 A2 1/2007

OTHER PUBLICATIONS

Mak J Y, "A New Integrated NGL Recovery/LNG Liquefaction Process" GPA Europe; Paris, France, Feb. 2007, Feb. 1, 2007 (Feb. 1, 2007); XP 007905163; figure 4.

*Primary Examiner* — Frantz F Jules
*Assistant Examiner* — Webeshet Mengesha
(74) *Attorney, Agent, or Firm* — Millen, White, Zelano & Branigan, P.C.; Brion P. Heaney

(57) ABSTRACT

A method for producing liquefied natural gas (LNG), wherein a feed natural gas (NG) containing methane and higher hydrocarbons, including benzene, is cooled to a first temperature level in a first cooling step using a first mixed refrigerant (WMR) and is subsequently subjected to counter-current absorption using an absorption liquid, wherein a gas fraction depleted in the higher hydrocarbons is formed, at least a portion of the gas fraction is cooled to a second temperature level in a second cooling step using a second mixed refrigerant (CMR) and is liquefied to form the liquefied natural gas (LNG), characterized in that the absorption liquid is formed from another portion of the gas fraction, which portion preferably condenses above the counter-current absorption and is returned to the counter-current absorption, in particular without a pump.

22 Claims, 2 Drawing Sheets

(58) Field of Classification Search
CPC .... F25J 2205/30; F25J 2205/50; F25J 1/0022; F25J 1/0042; F25J 1/0052; F25J 2200/78; F25J 2200/74
See application file for complete search history.

(56) References Cited

U.S. PATENT DOCUMENTS

| | | | | |
|---|---|---|---|---|
| 6,662,589 | B1 * | 12/2003 | Roberts | F25J 3/0242 62/425 |
| 2008/0016910 | A1 * | 1/2008 | Brostow | F25J 1/0262 62/612 |
| 2011/0023536 | A1 * | 2/2011 | Jager | F25J 1/0231 62/611 |
| 2013/0061632 | A1 | 3/2013 | Brostow et al. | |
| 2018/0209337 | A1 * | 7/2018 | Russo | F01D 25/28 |

* cited by examiner

METHOD AND SYSTEM FOR PRODUCING A LIQUEFIED NATURAL GAS PRODUCT

The invention relates to a method and a system for producing a liquefied natural gas product according to the preamble of the respective independent patent claim.

BACKGROUND

For liquefaction and non-pressurized storage, natural gas must be cooled down to low temperatures of approximately −160° C. In this state, the liquefied natural gas can be economically transported by cargo ship or truck, since it has only 1/600th of the volume of the gaseous substance at atmospheric pressure.

Natural gas generally contains a mixture of methane and higher hydrocarbons along with nitrogen, carbon dioxide, and further undesirable constituents. Prior to liquefaction, these components must be partially removed in order to avoid solidification during liquefaction or in order to satisfy customer requirements. The methods used for this purpose, such as adsorption, absorption, and cryogenic rectification are generally known.

For details on methods used in natural gas liquefaction, reference is made to technical literature, such as the article "Natural Gas" in Ullmann's Encyclopedia of Industrial Chemistry, online publication Jul. 15, 2006, DOI: 10.1002/14356007.a17_073.pub2, in particular Section 3, "Liquefaction."

In particular, mixed refrigerants consisting of various hydrocarbon components and nitrogen are used in natural gas condensing processes. For example, methods in which two mixed refrigerant circuits are used (dual mixed refrigerant (DMR) are known. In this way, natural gas, for example, which, in addition to methane, contains higher hydrocarbons, such as ethane, propane, butane, etc., but has already been freed of acid gases and dried beforehand, can be subjected to separation of the higher hydrocarbons and subsequent liquefaction. The separation of the higher hydrocarbons is accompanied by a separation of benzene, which is undesirable in the remaining liquefied natural gas. Benzene is used as a key or marker component in corresponding methods and can also be used as an indicator component for the separation.

Methods known from the prior art for natural gas liquefaction using corresponding mixed refrigerant circuits are often proven to be in need of improvement in practice for the reasons explained below.

The object of the present invention is, therefore, to improve natural gas liquefaction using two mixed refrigerant circuits.

DISCLOSURE OF THE INVENTION

Against this background, the present invention proposes a method for producing liquefied natural gas and a corresponding system according to the preambles of the respective independent claims. Each of the embodiments are the subject matter of the dependent claims and of the description below.

Prior to explaining the features and advantages of the present invention, some of the principles of the present invention are explained in greater detail, and terms used below will be defined.

The present application uses the terms "pressure level" and "temperature level" to characterize pressures and temperatures, which is supposed to mean that corresponding pressures and temperatures in a corresponding system do not have to be used in the form of exact pressure or temperature values. However, such pressures and temperatures typically fall within certain ranges that are, for example, ±10% about an average. In this case, corresponding pressure levels and temperature levels can be in disjointed ranges or in ranges that overlap one another. In particular, pressure levels, for example, include unavoidable or expected pressure losses. The same applies to temperature levels. The pressure levels indicated here in bar are absolute pressures.

Where "expansion machines" are referred to here, they are typically understood to mean known turboexpanders which have radial impellers arranged on a shaft. A corresponding expansion machine can, for example, be mechanically or hydraulically braked or coupled to a device, such as a compressor or a generator. Expansion of a mixed refrigerant within the scope of the present invention is typically carried out using an expansion valve and not using an expansion machine.

A "heat exchanger" for use within the scope of the present invention can be can be designed in any routine way in the art. It serves for the indirect transfer of heat between at least two fluid flows guided, for example, in a counter-current, here in particular a comparatively warm natural gas feed flow, or a gaseous fraction formed therefrom, and one or more cold mixed refrigerant flows. A corresponding heat exchanger can be formed from one or more heat exchanger sections connected in parallel and/or in series, e.g., from one or more wound heat exchangers or corresponding sections. In addition to wound heat exchangers of the type already mentioned, other types of heat exchangers may also be used within the scope of the present invention.

The relative spatial terms "upper," "lower," "over," "under," "above," "below," "adjacent to," "next to," "vertical," "horizontal," etc. here refer to the reciprocal arrangement of components during normal operation. An arrangement of two components "one above the other" is understood here to mean that the upper end of the lower of the two components is located at a lower geodetic height than the lower end of the upper of the two components or at the same geodetic height thereas, and the vertical projections of the two components overlap. In particular, the two components are arranged exactly one above the other, that is to say the central axes of the two components run on the same vertical straight line. However, the axes of the two components need not lie exactly vertically one above the other, they may also be offset from one another.

Within the scope of the present invention, a counter-current absorber is used. As regards the design and configuration of corresponding apparatuses, reference is made to relevant textbooks (see, for example, K. Sattler: Thermische Trennverfahren. Grundlagen, Auslegung, Apparate. Weinheim: Wiley-VCH, 3rd edition 2001). A counter-current absorber typically has a liquid fraction ("sump liquid") and a gaseous fraction ("head gas") removable from a lower region ("sump") and an upper region ("head"), respectively. Counter-current absorbers are also generally known from the field of separation technology. They are used for absorption in the phase counter-current and are therefore also referred to as counter-current columns. During absorption in the counter-current, the releasing gas phase flows upwards through an absorption column. The receiving solution phase, provided from above and withdrawn at the bottom, flows towards the gas phase. The gas phase is "washed" with the solution phase. Built-in components that ensure a gradual (trays, spray zones, rotating plates, etc.) or continuous (random filling of filling material, packings, etc.) phase contact are typically provided in a corresponding absorption column. A liquid flow, also referred to as "absorption liquid," is fed into an upper region of a counter-current absorber, whereby components are washed out of a gaseous flow that is fed in lower.

Where reference is made hereinafter to a "feed natural gas," this is understood to mean natural gas that has been subjected in particular to acid gas removal and optional further processing so that it is suitable for liquefaction, i.e. does not have any components that solidify ("freeze out") in the proposed method. In particular, heavy hydrocarbons, such as butane(s) and/or pentane(s), along with hydrocarbons having six or more carbon atoms, may already have been separated from the corresponding feed natural gas. The feed natural gas is, in particular, anhydrous and has a content of, for example, more than 85% methane and contains, in particular, ethane and propane in the remainder, but also butane and pentane and possibly heavier hydrocarbons. If necessary, this can be a lower fraction than in a (raw) natural gas used to form the feed natural gas; for example, it can be extracted from a drill hole. Nitrogen, helium and other light components may also still be contained. The terms "butane" and "pentane" are intended here to be representative of all butane and pentane isomers, but refer in particular to n-butane and iso-butane along with n-pentane and iso-pentane. Although not mentioned here, in addition to the cited saturated compounds (ethane, propane, butane, pentane), the unsaturated derivatives and their isomers, which generally pass into the indicated fraction of the corresponding chain-length equivalent compounds in the separations or fractionation, may also be present.

Where "liquefied natural gas" or a "liquefied natural gas product" is referred to below, it is understood to mean a cryogenic liquid at the atmospheric boiling point of methane or below, in particular at −160 to −164° C., which comprises more than 85% methane, in particular more than 90% methane, and the methane content of which is in any case higher than that of the feed natural gas. The liquefied natural gas is, in particular, significantly lower in benzene than the feed natural gas and comprises only a predetermined maximum benzene content. In addition to methane, it can also have smaller fractions of other aliphatic hydrocarbons, in particular ethane, propane and butane along with their unsaturated derivatives, in particular in contrast to the usual composition of liquefied natural gas (LNG). It will nevertheless be referred to in the following by the abbreviated designation "LNG."

Features and Advantages of the Invention

A method for producing a liquefied natural gas (LNG) product according to the invention comprises providing feed natural gas containing methane and at least ethane, propane and butane as higher hydrocarbons. The feed natural gas can also contain other higher hydrocarbons, in particular benzene. The feed natural gas is subjected to cooling in a first cooling step using a first warm mixed refrigerant (WMR) to a first temperature level. The feed natural gas cooled in the first cooling step is subjected, after the first cooling step, at least in part to counter-current absorption to form a gas fraction depleted in the higher hydrocarbons using an absorption liquid. A part of the gas fraction is subjected to cooling and liquefaction in a second cooling step using a second cold mixed refrigerant (CMR) to a second temperature level to form the liquefied natural gas (LNG) product.

The feed natural gas can be provided using, in particular, drying, acid gas removal, partial removal of heavier hydrocarbons, compression, and the like, as known per se. According to the invention, the absorption liquid is formed from another part of the gas fraction which is condensed and returned to the counter-current absorption. In particular, condensation can take place above the counter-current absorption, so that pump-free recirculation is possible. However, a return pump can also be used. Preferably, the first and second mixed refrigerants are low-propane or propane-free.

The invention is characterized by further treating a sump liquid formed in counter-current absorption containing ethane, propane, butane and pentane. The sump liquid formed in the counter-current absorption is subjected, at least in part, to a first fractionation, wherein a sump product low in propane and containing butane and pentane, along with an overhead product, are formed. The sump product formed in the first fractionation is subjected, at least in part, to a second fractionation, wherein an overhead product low in propane and containing butane, along with a sump product, are formed. The overhead product formed in the second fractionation is partially added to the first mixed refrigerant as required (make-up). The first fractionation is in particular in the form of a known C3/C4 separation (C3 separation, depropanization); the second fractionation is in particular in the form of a known C4/C5 separation (C4 separation, debutanization).

The present invention offers the advantage that the components of the mixed refrigerant circuits, in particular butane, can be obtained simply and with comparatively little effort from the sump of the counter-current absorber, i.e. internally in the method. A fractionation sequence with four fractionations that can be used as an alternative to the present invention, in which methane, ethane, propane and butane are separated in succession, i.e. a C1/C2 separation (demethanization) followed by a C2/C3 separation (deethanization), a C3/C4 separation (depropanization) and a C4/C5 separation (debutanization), is less advantageous compared to the separation sequence proposed herein, as recognized according to the invention. In such an alternative fractionation sequence, four separation columns are required; these have to be operated permanently and sometimes yield undesired products (in particular a propane fraction) which, if not required in themselves, have to be returned. Thus, the separation effort required for a corresponding fraction is partially ineffectual. The same applies to methods in which the sequence of C1/C2 separation (demethanization) and C2/C3 separation are reversed.

In contrast, the method according to the invention offers a cost advantage in terms of investment and operating costs, since at least one separation column can be dispensed with completely, and a further separation column is only connected in the event of an additional demand for C2 refrigerant, as explained further below, but does not usually have to be operated. Within the scope of the invention, the sump product of counter-current absorption is, in particular, directly fed to depropanization, in contrast to conventional separation sequences, and its sump product is subjected to debutanization. Thus, a makeup flow low in propane and containing butane can be provided for the first mixed refrigerant in two separation steps. As required, the overhead product of depropanization, i.e. the first fractionation containing ethane and propane, can be subjected to deethanization for intermittent generation of refrigerant. However, as mentioned, this is optionally pursued.

Within the scope of the present invention, the sump product of the absorption column is in particular fed directly to the first fractionation, i.e. depropanization, which is carried out, for example, at a pressure level of 10 to bar, preferably between 15 and 20 bar. The low-propane sump product of the first fractionation, which in particular has less than 2 mol % of propane and preferably less than 0.5 mol % of propane, is in particular fed directly to the second fractionation, i.e. debutanization, which is carried out, for example, at a pressure level of 3 to 10 bar, preferably between 4 and 7 bar. Due to the previous first fractionation, butane that is low in propane, i.e. containing in particular less than 5 mol % of propane and preferably less than 2 mol % of propane, is withdrawn overhead from the second fractionation. In particular, this also contains less than 1 mol % of pentane and preferably less than 0.2 mol % of pentane. The butane obtained in this way can be used, at least in part, to feed the first or warm mixed refrigerant circuit. A sump product low in butane, i.e. containing less than 2 mol % butane in particular, and preferably less than 0.5 mol % butane, is further withdrawn from the second fractionation. This contains pentane and possibly once again longer-chain hydrocarbons. As mentioned, in all cases, unsaturated hydrocarbons can also be fed into the fractionations and separated accordingly, in particular passing into the corresponding fractions with the respective chain-length equivalent saturated hydrocarbons.

A similar method for producing liquefied natural gas using two mixed refrigerants, but in which the proposed fractionation sequence according to the invention is not used, is disclosed for example in U.S. Pat. No. 6,119,479 A. In this method, the higher hydrocarbons contained in the natural gas feed can be separated from it in a counter-current absorber as required. Methods and systems of a similar type are also disclosed, for example, in U.S. Pat. No. 6,370,910 A and AU 2005224308 B2.

In both the first and second cooling steps of the present invention, as mentioned, mixed refrigerants are used in corresponding refrigerant circuits. In particular, the first mixed refrigerant is, in the following sequence, subjected to compression in gaseous form, condensed by cooling, subcooled, expanded, heated in a first heat exchanger, in particular completely evaporated thereby, and then again subjected to compression. The subcooling of the first mixed refrigerant can take place, in particular, in the first heat exchanger, the previous cooling in a further heat exchanger. Furthermore, the second mixed refrigerant is subjected to compression, in particular in gaseous form, condensed by cooling, subcooled, expanded, heated in a second heat exchanger, in particular completely evaporated thereby, and subsequently subjected to compression again. The subcooling of the second mixed refrigerant can take place, in particular, in the second heat exchanger, the previous cooling in the first and the second heat exchangers.

In particular, the cooling of the overhead product from counter-current absorption can be performed at least in part using the second mixed refrigerant which was previously used in the second cooling step. For this purpose, it is extracted from a heat exchanger used in the second cooling step and passed through a separate heat exchanger that is used for cooling the overhead product from counter-current absorption, or a corresponding part.

The first and second heat exchangers are in particular used in a manner known per se as coiled heat exchangers (coil wound heat exchanger, CWHE), wherein the mixed refrigerant is heated, after its expansion, in particular on the jacket side, i.e., in a jacket space containing or surrounding the heat exchanger tubes in which the mixed refrigerant is expanded. The media to be cooled down are guided tube-side, i.e., through the correspondingly provided heat exchanger tubes. The heat exchanger tubes are provided in bundles in corresponding heat exchangers so that the term "tube-side" or "(tube) bundle-side" is used here for a corresponding flow guide. The first cooling step to which the feed natural gas is subjected is carried out in particular using the first heat exchanger, and the second cooling step to which the gas fraction from the counter-current absorber is subjected is carried out in particular using the second heat exchanger.

Methods for natural gas liquefaction must be flexibly adaptable to different system capacities and operating conditions. The explained methods which use two mixed refrigerant circuits are preferably used when large ambient temperature fluctuations result in significantly different refrigerant condensation conditions. These can be taken into account more efficiently if a mixture comprising refrigerant components is used instead of a single pure component, such as propane.

Given the combination of high volatility and high molecular weight, propane is considered a hazardous refrigerant since it can collect in low-lying areas and possibly cause explosions. Therefore, methods using two mixed refrigerant circuits and a correspondingly reduced propane fraction therein are, as used according to the invention, a preferred solution for system layouts having limited installation space, for example modularized systems and/or floating systems in which the footprint is limited.

A compact system layout (e.g., mandatory for offshore installations) can be achieved by minimizing the number of system components and by reducing the space between the systems, which can be determined based on safety aspects. The system components known to be hazardous include pumps for liquid hydrocarbons (risk of leakage and liquid discharge) and all types of devices that contain significant amounts of liquid propane.

The aspects of the present invention already briefly mentioned will be summarized again below in different words.

Advantageously, the overhead product formed in the first fractionation comprises ethane and propane, wherein at least a part of the overhead product formed in the first fractionation is partially condensed to obtain a condensate, and wherein the condensate is partially or completely used as a return flow in the counter-current absorption. The advantage is, in particular, that counter-current absorption can be supported in this way if no further product is to be obtained from the overhead product formed in the first fractionation. In particular, the partial condensation can in particular comprise cooling using the first mixed refrigerant which can be used for this purpose in the form of a partial flow in a further heat exchanger or head condenser.

In a different embodiment or in a first operating mode, a first fraction of the condensate obtained from the partial condensation of at least part of the overhead product formed in the first fractionation can be used as a return flow in counter-current absorption, and the second fraction can be subjected to a third fractionation in which an overhead product low in propane and containing ethane and a sump product low in ethane and containing propane are formed. In this way, a refrigerant containing ethane, in particular the aforementioned first and second mixed refrigerant, can be provided as required. In particular, a partial flow of the first mixed refrigerant can be used for overhead cooling in the third fractionation.

In particular, the first and second mixed refrigerants may be compressed using a common drive or separate drives of any type, and the first cooling step can comprise the use of a first heat exchanger, and the second cooling step can comprise the use of a second heat exchanger. In particular, the first mixed refrigerant comprises on the one hand a very large fraction of ethane and butane or their saturated and unsaturated derivatives, and the second mixed refrigerant comprises on the other hand a very large fraction of nitrogen, methane and ethane and their derivatives. In each case, traces of other compounds, in particular lighter and/or heavier hydrocarbons, may be present.

In particular, a gas mixture having 75 to 98 mole percent methane, 2 to 20 mole percent ethane, 0.5 to 5 mole percent propane, 0.3 to 3 mole percent butane and 0.1 to 2 mole percent pentane and higher hydrocarbons can be used as a feed natural gas within the scope of the present invention.

Within the scope of the invention, counter-current absorption can be carried out in particular at a pressure level of 40 to 70 bar and/or a temperature level at the head of −30 to −60° C., the first fractionation is carried out at a pressure level of 10 to 25 bar and/or a temperature level at the head of 20 to 60° C., the second fractionation is carried out at a pressure level of 3 to 7 bar and/or a temperature level at the head of 20 to 60° C., and/or the third fractionation is carried out at a pressure level of 20 to 30 bar and/or a temperature level at the head of −20 to −50° C. This results in a pressure increase only between the third and the first fractionation, which must be accordingly overcome by compression or pumping. Pumps and compressors can be dispensed with for all other transfers between the individual system components since expansion takes place in each case.

With regard to the device provided according to the invention and its features, reference is expressly made to the corresponding independent device claim and the above explanations of the method according to the invention, since these likewise concern a corresponding device. The same applies in particular to an embodiment of a corresponding device which is advantageously configured for carrying out a corresponding method in any embodiment.

The invention is further explained below with reference to the figures which illustrate an embodiment of the present invention in comparison to the prior art.

In the following further description, systems not according to the invention and formed according to embodiments of the invention are described and, on the basis of these, corresponding method steps are described. For the sake of simplicity and to avoid repetition, the same reference signs and explanations are used here for method steps and system components (for example, a cooling step and a heat exchanger used for this purpose).

DETAILED DESCRIPTION OF THE FIGURES

Figure 1:
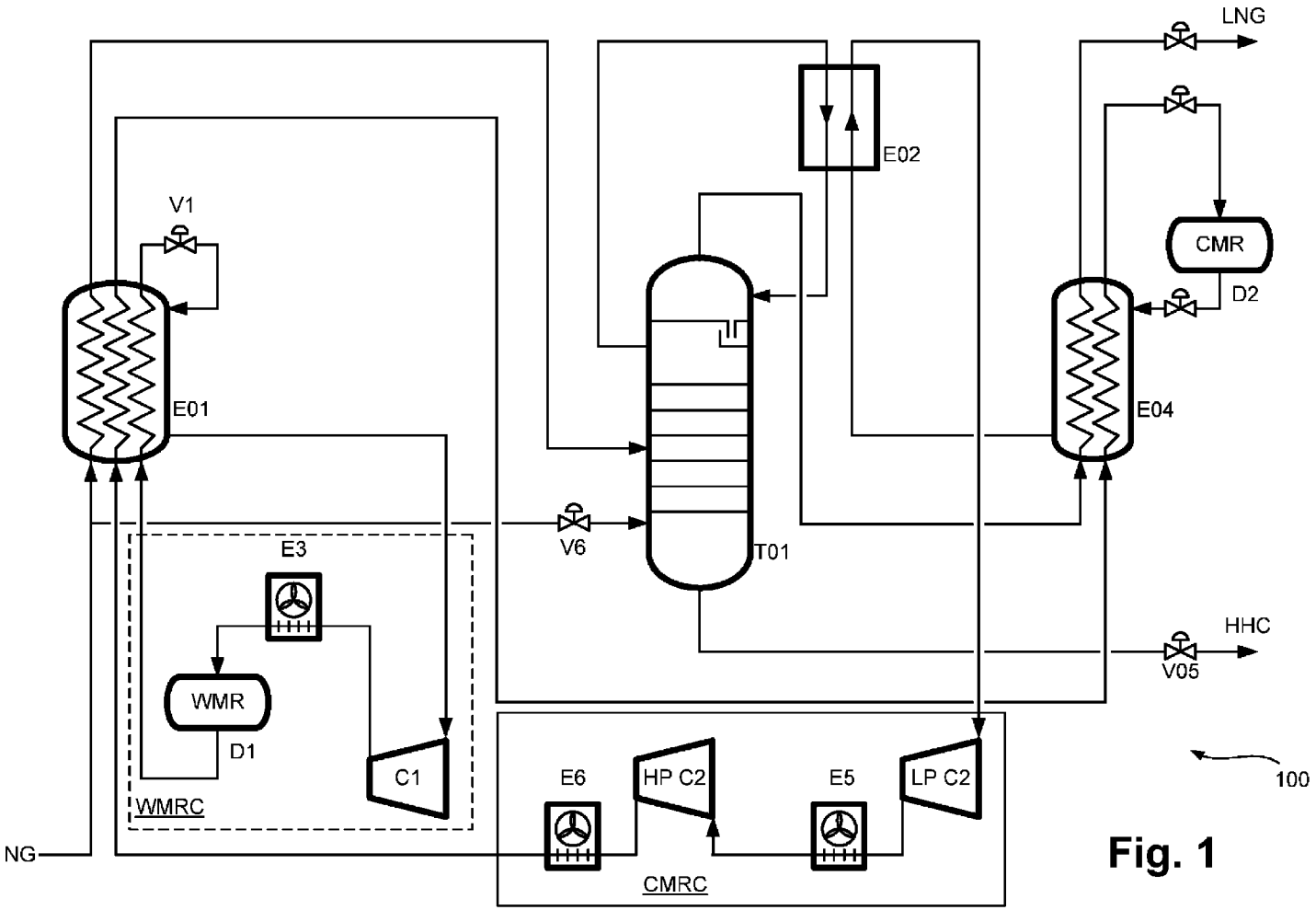
FIG. 1 shows a system not according to the invention to illustrate the background of the invention.

In an embodiment of a system for natural gas liquefaction not according to the invention as shown in FIG. 1 and identified overall with 100, feed natural gas NG, which is first divided into two partial flows, is supplied. A first partial flow is cooled down in a first heat exchanger E01, which can in particular be formed as a wound heat exchanger, in a first cooling step to a first temperature level of, for example, −20° C. to −70° C. and subsequently fed approximately to the middle of a counter-current absorber T01.

Furthermore, the second partial flow of the natural gas feed NG, which is expanded via a valve V6, is fed into a lower region of the counter-current absorber T01 where it rises substantially in gaseous form. Gas is withdrawn from an upper region of the counter-current absorber T01 and is cooled down in a head condenser E02 which can be formed, for example, as a plate heat exchanger, and is fed into a head space of the counter-current absorber T01. Liquid separating here is returned as a return flow to the counter-current absorber T01 and washes out heavier components from the natural gas feed which pass into a sump liquid of the counter-current absorber T01.

The sump liquid of the counter-current absorber T01 can be expanded via a valve V05 and discharged from the system 100 as a heavy fraction HHC (heavy hydrocarbon). Head gas of the counter-current absorber T01, i.e. a methane-rich gas fraction is, in contrast, cooled down to a liquefaction temperature in a second heat exchanger E04, which can also be formed as a wound heat exchanger, and after expansion is discharged from the system 100 via a valve as liquefied natural gas LNG.

The system 100 comprises two mixed refrigerant circuits. In a first mixed refrigerant circuit WMRC, a first ("warm") mixed refrigerant WMR is subjected to single-stage compression in gaseous form in a compressor C1 and subsequently cooled down in an air cooler and/or water cooler E3 and thereby condensed. Condensate can be obtained in a separation vessel D1.

This is first further cooled down in the first heat exchanger E01 on the tube bundle side, subsequently expanded via a valve V1 and fed into the jacket space of the first heat exchanger E1 where it is heated, completely evaporated and subsequently again subjected to compression.

In this method not according to the invention, the compression of the first mixed refrigerant takes place in particular in the single-stage compressor C1 without intermediate cooling in order to reduce a risk of partial condensation and to avoid a need to convey the condensate to the high-pressure side of the compressor.

Furthermore, in the system 100, a second ("cold") mixed refrigerant CMR in gaseous form is subjected to a stepwise compression in compressors LP C2 and HP C2 in a second mixed refrigerant circuit CMRC and subsequently cooled down, for example in air coolers and/or water coolers E5 and E6. Further cooling takes place on the tube bundle side in the first heat exchanger E01 and thereafter in the second heat exchanger E04. After subsequent expansion in a valve, feeding into a buffer tank D2 takes place. Condensate withdrawn therefrom is expanded via a valve and fed jacket-side into the second heat exchanger E04 where it is heated and completely evaporated. The gaseous second mixed refrigerant CMR is used as refrigerant in the aforementioned head condenser E02 before it is again subjected to compression.

A return pump can be dispensed with by installing the head condenser E02, which is operated using cold from the second mixed refrigerant CMR, which leaves the second heat exchanger E04 as a vapor above the counter-current absorber T01. In contrast, the return flow formed from the gas from the counter-current absorber T01 is returned to the counter-current absorber T01 purely by the effect of gravity.

Contrary to the just explained method not according to the invention, in the method according to the invention, the mixed refrigerant is obtained within the method. However, in comparison with methods known from the prior art, at least one separation column is dispensed with which considerably reduces the required installation space. Propane in the mixed refrigerants is largely dispensed with for the reasons explained at the beginning. These advantages are achieved by the proposed measures according to the invention and corresponding advantageous embodiments. In particular, propane present in the feed natural gas NG can be transferred to the liquefied natural gas LNG without being specially separated for this purpose.

Figure 2:
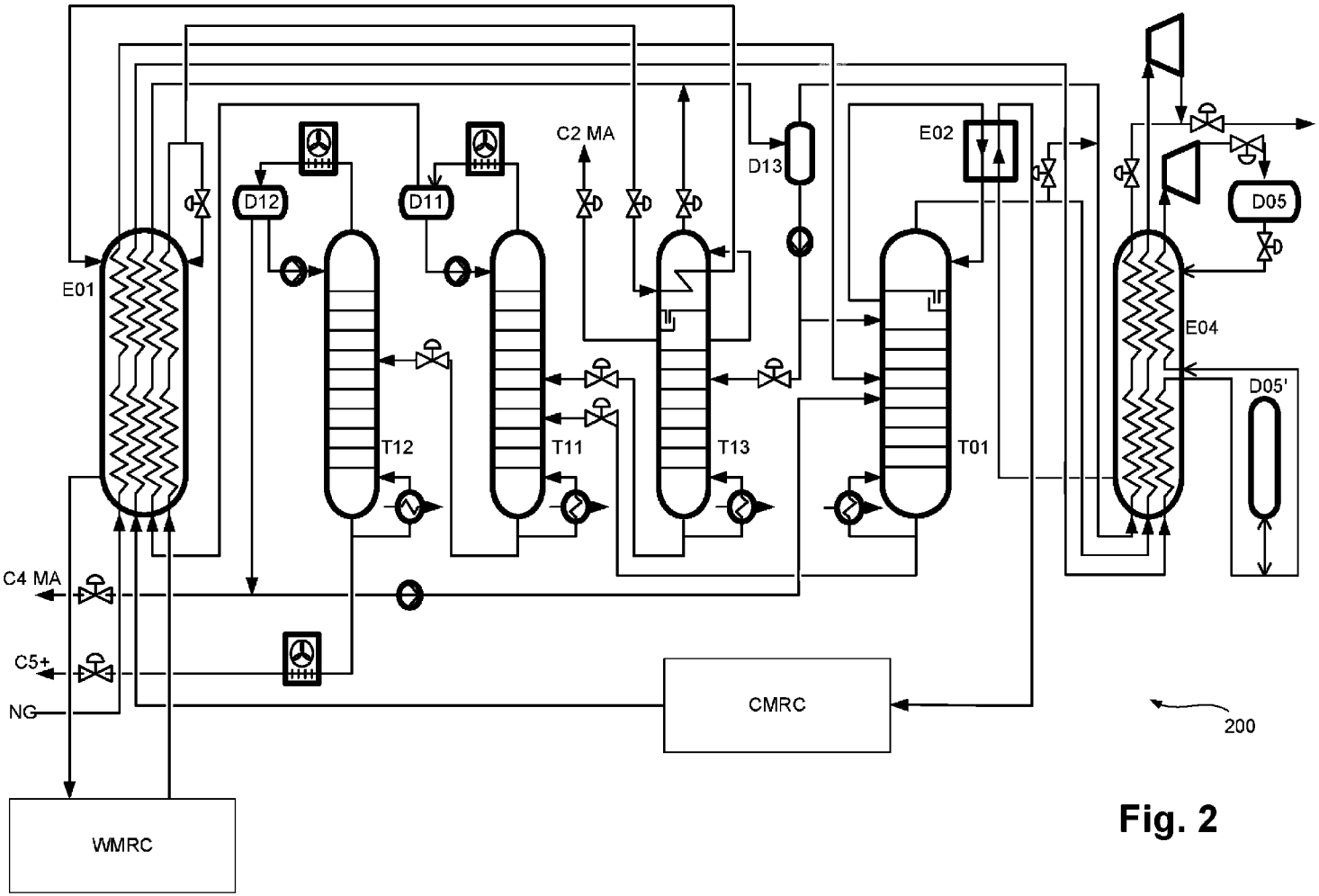
FIG. 2 shows a schematic representation of an advantageous design of a system according to the invention.

In FIG. 2, an advantageous embodiment of the system according to the invention is shown in simplified form and identified as 200.

In addition to the components of the system 100 described with reference to FIG. 1, the system 200 comprises three separation columns T11, T12, T13, each of which is configured to carry out fractional distillation of at least part of the sump product withdrawn from the counter-current absorber T01.

For reasons of clarity, the components already described will not be explained in more detail here. It should be noted that the two mixed refrigerants CMR and WMR are fed in separate circuits WMRC and CMRC, which are each shown combined into a block in FIG. 2. The actual design of such circuits may differ from the embodiment explained with reference to FIG. 1. However, it is particularly decisive here, as in system 100, that the first mixed refrigerant WMR is fed into the first heat exchanger E01 at a working temperature level in the range from −30° C. to −60° C., preferably from −40° C. to −50° C., and the second mixed refrigerant is fed into the second heat exchanger E04 at a working temperature level in the range from −140° C. to −165° C., preferably from −150° C. to −160° C. In principle, all known methods can be considered for providing the respective mixed refrigerant CMR, WMR, such as a combination of compression, cooling and expansion, in particular in the form of a conventional refrigerating machine.

A buffer functionally corresponding to buffer tank D2, as described with reference to FIG. 1, for storing the second mixed refrigerant can be formed as a low-pressure buffer tank D05 or as a high-pressure buffer tank D05'. The high-pressure buffer tank D05' has the advantage of taking up less installation space, while the low-pressure buffer tank D05 can be designed less robust and therefore possibly lighter, but must be installed above the heat exchanger E04 in order to avoid a pump.

The feed natural gas NG, which here explicitly contains methane and at least ethane, propane, butane and pentane as higher hydrocarbons, is cooled down as before but completely in the shown example, i.e. without splitting into partial flows, substantially as before to a first temperature level in a first cooling step in the first heat exchanger E01 using a first mixed refrigerant WMR. The feed natural gas NG, after the first cooling step in the first heat exchanger E01, is subjected, at least in part, to counter-current absorption in the counter-current absorber T01 using an absorption liquid provided substantially as before, wherein a gas fraction depleted in the higher hydrocarbons is formed.

The absorption liquid is therefore also formed here from another part of the gas fraction formed in the counter-current absorber T01. This is condensed above the counter-current absorber T01 and returned to the counter-current absorber T01. A part of the gas fraction formed in the counter-current absorber T01 is cooled to a second temperature level in a second cooling step in the heat exchanger E04 using the second mixed refrigerant CMR and is liquefied to form the liquefied natural gas LNG.

During operation of the system 200, the sump flow of the counter-current absorber T01 is at least partially first subjected to a first fractionation T11 (depropanizer) in which an overhead mixture enriched in propane and lighter components and a sump mixture enriched in components that boil higher than propane, in particular butane, is formed. For this purpose, the separation column T11, along with all other separation columns T01, T12, T13 of the system 200, is equipped with suitable built-in components and is preferably operated at a pressure level in the range of 10 to 25 bar, preferably 15 to 20 bar.

Under the aforementioned conditions, the sump product formed in counter-current absorption T01 comprises ethane, propane, butane and pentane, along with possibly higher hydrocarbons, and is subjected at least in part to a first fractionation in separation column T11 in which a sump product low in propane and containing butane and pentane, along with an overhead product, are formed.

From a return collector D11, into which at least the overhead product of the first fractionation T11 is fed, a fraction containing propane and ethane along with possibly lower-boiling hydrocarbons is advantageously extracted in gaseous form, cooled in the first heat exchanger E01 against evaporating first mixed refrigerant WMR and thereby partially condensed. The liquid formed thereby is advantageously separated in a separator D13 and, in normal operation, is fed, in particular completely, to counter-current absorption T01 as a return flow.

The sump product of the first fractionation T11 is subjected at least in part to a second fractionation in the second separation column T12 in which an overhead product low in propane and containing butane and a sump product are formed, and the overhead product formed in the second fractionation in the second separation column T12 is added at least in part to the first mixed refrigerant WMR.

More precisely, the overhead product of the second separation column T12 is condensed in the head condenser of the second separation column T12 and at least partially fed thereto as a return flow. The condensed overhead product can be collected in a condensate collector D12, for example for use as a makeup C4 MA for the first mixed refrigerant WMR or for return to the counter-current absorber T01.

In order to additionally recover ethane, for example as a makeup C2 MA for a further refrigerant circuit, a partial amount (for example 10-80%, preferably 30-50%) of the liquid collected in the separator D13 is advantageously subjected to a third fractionation T13 (deethanizer) as required, i.e. in a corresponding operating mode. A low-propane fluid containing ethane can be extracted therefrom below the head condenser. Since the third fractionation T13 is operated at a higher pressure than the first fractionation T11, the feed takes place via a pump, and material flows can be fed back directly into the first fractionation T11 or mixed with the partially condensed overhead product of the first fractionation T11.

Ultimately, a large part of the methane, ethane and propane contained in the feed natural gas NG is accordingly transferred to the liquefied natural gas LNG, wherein a part of the ethane can be recovered as refrigerant. Heavier components of the feed natural gas NG are separated separately, wherein, butane in turn can be recovered as a starting material for the first mixed refrigerant WMR. Overall, it should be noted that, contrary to methods known from the prior art, at least one separation column that is conventionally used to separate a methane-rich flow from the partially liquefied feed gas NG can be omitted.

The invention claimed is:

1. A method for producing a liquefied natural gas (LNG) product, comprising:

providing a feed natural gas (NG) containing methane and at least ethane, propane, butane and pentane as higher hydrocarbons, cooling the feed natural gas (NG) to a first temperature level in a first cooling step using a first mixed refrigerant (WMR), after the first cooling step, subjecting the feed natural gas (NG) at least in part to counter-current absorption in an absorber using an absorption liquid, in which a gas fraction depleted in the higher hydrocarbons is formed, and cooling at least a part of the gas fraction formed in the counter-current absorption to a second temperature level in a second cooling step and liquifying the at least a part of the gas fraction formed in the counter-current absorption using a second mixed refrigerant (CMR) to form the liquefied natural gas (LNG) product, wherein the absorption liquid is formed from another part of the gas fraction formed in the counter-current absorption, which is condensed and returned to the counter-current absorption, a sump product containing at least ethane, propane, butane and pentane is formed in the counter-current absorption, the sump product formed in the counter-current absorption is directly fed to a first separation column and subjected, at least in part, to a first fractionation in which a sump product low in propane and containing butane and pentane, along with an overhead product, are formed, the sump product formed in the first fractionation is subjected, at least in part, to a second fractionation in a second separation column in which an overhead product low in propane and containing butane, along with a sump product, are formed, and the overhead product formed in the second fractionation is at least partially added to the first mixed refrigerant (WMR).

2. The method according to claim 1, wherein the overhead product formed in the first fractionation contains ethane and propane, wherein at least a part of the overhead product formed in the first fractionation is partially condensed to obtain a condensate, and wherein the condensate is partially or completely used as a return flow in the counter-current absorption.

3. The method according to claim 2, wherein the partial condensation of the at least a part of the overhead product formed in the first fractionation comprises cooling using the first mixed refrigerant (WMR).

4. The method according to claim 2, wherein a first fraction of the condensate obtained from the partial condensation of the at least part of the overhead product obtained in the first fractionation is used, in a first operating mode, as a return flow in the counter-current absorption, and a second fraction of the at least part of the overhead product obtained in the first fractionation is subjected to a third fractionation in a third separation column in which an overhead product low in propane and containing ethane and a sump product low in ethane and containing propane are formed.

5. The method according to claim 4, wherein a partial flow of the first mixed refrigerant is used for overhead cooling in the third fractionation.

6. The method according to claim 4, wherein the overhead product formed in the third fractionation is used at least partially liquefied as refrigerant.

7. The method according to claim 1, wherein the first (WMR) and second (CMR) mixed refrigerants are compressed using a common drive or separate drives.

8. The method according to claim 1, wherein the first cooling step comprises the use of a first heat exchanger, and the second cooling step comprises the use of a second heat exchanger.

9. The method according to claim 1, wherein the feed natural gas (NG) has 75 to 98 mole percent methane, 2 to 20 mole percent ethane, 0.5 to 5 mole percent propane, 0.3 to 3 mole percent butane, and 0.1 to 2 mole percent pentane and higher hydrocarbons.

10. The method according to claim 1, wherein the counter-current absorption is carried out at a pressure level of 40 to 70 bar.

11. A system for producing a liquefied natural gas (LNG) product comprising:

means to provide a feed natural gas (NG) containing methane and at least ethane, propane, butane and pentane as higher hydrocarbons, means to cool the feed natural gas (NG) to a first temperature level in a first cooling step using a first mixed refrigerant (WMR), after the first cooling step, means to subject the feed natural gas (NG), at least in part, to counter-current absorption using an absorption liquid, in which counter-current absorption a gas fraction depleted in the higher hydrocarbons is formed, means to cool a part of the gas fraction formed in the counter-current absorption to a second temperature level in a second cooling step using a second mixed refrigerant (CMR) and liquefying the part of the gas fraction formed in the counter-current absorption to form the liquefied natural gas (LNG), means for condensing another part of the gas fraction formed in the counter-current absorption to form the absorption liquid and means to return the formed absorption liquid to the counter-current absorption, means for removing a sump product containing at least ethane, propane butane and pentane from the counter-current absorption, means to directly feed at least part of the sump product formed in the counter-current absorption to a means for a first fractionation wherein a sump product low in propane and containing butane and pentane, along with an overhead product, are formed from the at least part of the sump product formed in the counter-current absorption, means to subject the sump product formed in the first fractionation, at least in part, to a second fractionation, in which an overhead product low in propane and containing butane, along with a sump product, are formed, and means to add the overhead product formed in the second fractionation at least partially to the first mixed refrigerant and/or to the second mixed refrigerant (WMR, CMR).

12. A system for producing a liquefied natural gas (LNG) product according to the method of claim 1 comprising:

means to provide a feed natural gas (NG) containing methane and at least ethane, propane, butane and pentane as higher hydrocarbons, means to cool the feed natural gas (NG) to a first temperature level in a first cooling step using a first mixed refrigerant (WMR), after the first cooling step, means to subject the feed natural gas (NG), at least in part, to counter-current absorption using an absorption liquid, in which counter-current absorption a gas fraction depleted in the higher hydrocarbons is formed, and means to cool a part of the gas fraction formed in the counter-current absorption to a second temperature level in a second cooling step using a second mixed refrigerant (CMR) and liquefying the part of the gas fraction formed in the counter-current absorption to form the liquefied natural gas (LNG), means for condensing another part of the gas fraction formed in the counter-current absorption to form the absorption liquid and means to return the formed absorption liquid to the counter-current absorption, means for removing a sump product containing at least ethane, propane butane and pentane from the counter-current absorption, means to directly feed at least part of the sump product formed in the counter-current absorption to a means for a first fractionation wherein a sump product low in propane and containing butane and pentane, along with an overhead product, are formed from the at least part of the sump product formed in the counter-current absorption, means to subject the sump product formed in the first fractionation, at least in part, to a second fractionation, in which an overhead product low in propane and containing butane, along with a sump product, are formed, and to add the overhead product formed in the second fractionation at least partially to the first mixed refrigerant and/or to the second mixed refrigerant (WMR, CMR).

13. The method according to claim 1, wherein the counter-current absorption is carried out at a temperature level of −30 to −60° C. at a head of the absorber.

14. The method according to claim 1, wherein the first fractionation is carried out at a pressure level of 10 to 25 bar.

15. The method according to claim 1, wherein the first fractionation is carried out at a temperature level of 20 to 60° C. at a head of the first separation column.

16. The method according to claim 1, wherein the second fractionation is carried out at a pressure level of 3 to 7 bar.

17. The method according to claim 1, wherein the second fractionation is carried out at a temperature level of 20 to 60° C. at a head in the second separation column.

18. The method according to claim 4, wherein the third fractionation is carried out at a pressure level of 20 to 30 bar.

19. The method according to claim 4, wherein the third fractionation is carried out at a temperature level of −20 to −50° C. at a head in the third separation column.

20. The method according to claim 1, wherein, in the first cooling step, at least a part of the overhead product formed in the first fractionation and the second mixed refrigerant (CMR) are cooled using the first mixed refrigerant (WMR).

21. The method according to claim 20, wherein, after the first cooling step, a portion of the part of the overhead product formed in the first fractionation is cooled in the second cooling step using the second mixed refrigerant (CMR).

22. The method according to claim 1, wherein the method does not include a separation column for separating a methane-rich flow from the feed natural gas (NG).

* * * * *